US012569029B2

(12) United States Patent
Kozuka et al.

(10) Patent No.: US 12,569,029 B2
(45) Date of Patent: Mar. 10, 2026

(54) SOLE AND SHOE

(71) Applicant: ASICS CORPORATION, Kobe (JP)

(72) Inventors: Yuya Kozuka, Kobe (JP); Shingo Takashima, Kobe (JP); Norihiko Taniguchi, Kobe (JP)

(73) Assignee: ASICS CORPORATION, Kobe (JP)

( * ) Notice: Subject to any disclaimer, the term of this patent is extended or adjusted under 35 U.S.C. 154(b) by 66 days.

(21) Appl. No.: 18/383,392

(22) Filed: Oct. 24, 2023

(65) Prior Publication Data

US 2024/0138518 A1 May 2, 2024

(30) Foreign Application Priority Data

Oct. 26, 2022 (JP) ..... 2022-171333

(51) Int. Cl.

| | |
|---|---|
| ***A43B 7/14*** | (2022.01) |
| ***A43B 7/148*** | (2022.01) |
| ***A43B 13/12*** | (2006.01) |
| ***A43B 13/18*** | (2006.01) |

(52) U.S. Cl.

CPC ..... *A43B 13/125* (2013.01); *A43B 7/148* (2013.01); *A43B 13/127* (2013.01); *A43B 13/186* (2013.01)

(58) Field of Classification Search

CPC ..... A43B 7/148; A43B 7/149; A43B 13/125; A43B 13/127; A43B 13/181; A43B 13/185; A43B 13/186

See application file for complete search history.

(56) References Cited

U.S. PATENT DOCUMENTS

| | | | | |
|---|---|---|---|---|
| 3,834,046 | A * | 9/1974 | Fowler | A43B 13/185 36/28 |
| 4,598,487 | A * | 7/1986 | Misevich | A43B 13/187 36/129 |
| 5,595,003 | A * | 1/1997 | Snow | A43B 13/181 36/31 |
| 5,718,063 | A * | 2/1998 | Yamashita | A43B 1/0072 36/35 B |
| 6,516,539 | B2 * | 2/2003 | Nishiwaki | A43B 7/1464 36/35 R |
| 9,833,038 | B2 | 12/2017 | Foxen et al. | |
| 2002/0073579 | A1 * | 6/2002 | Lombardino | A43B 13/182 36/28 |

(Continued)

FOREIGN PATENT DOCUMENTS

| | | | | |
|---|---|---|---|---|
| KR | 101351057 | B1 * | 1/2014 | A43B 13/182 |

*Primary Examiner* — Sharon M Prange

(74) *Attorney, Agent, or Firm* — KONRAD, RAYNES, DAVDA & VICTOR LLP; Alan S. Raynes

(57) ABSTRACT

A sole includes: a sole body; an elastic portion disposed adjacent to the sole body; a surrounding member that surrounds the elastic portion, and a pressing member. Tensile rigidity of the surrounding member in a thickness direction is higher than compression rigidity of the elastic portion in the thickness direction and higher than compression rigidity of the surrounding member in the thickness direction. An uncompressed thickness of the elastic portion in an uncompressed state is larger than an initial thickness of the surrounding member in an initial state. A reference thickness of the elastic portion and the surrounding member in an unloaded state is smaller than the uncompressed thickness of the elastic portion and larger than the initial thickness of the surrounding member.

20 Claims, 16 Drawing Sheets

(56) References Cited

U.S. PATENT DOCUMENTS

| | | | | |
|---|---|---|---|---|
| 2014/0075779 | A1* | 3/2014 | Bruce | A43B 13/181 36/29 |
| 2014/0259746 | A1* | 9/2014 | Abshire | A43B 13/181 36/28 |
| 2016/0278481 | A1* | 9/2016 | Le | A43B 7/144 |
| 2021/0037914 | A1* | 2/2021 | Adametz | A43B 13/182 |
| 2023/0062223 | A1* | 3/2023 | Taniguchi | A43B 5/06 |
| 2023/0200485 | A1* | 6/2023 | Kajiwara | A43B 7/1425 36/25 R |
| 2023/0309652 | A1* | 10/2023 | Sakamoto | A43B 7/143 36/25 R |
| 2024/0074530 | A1* | 3/2024 | Tateno | A43B 13/188 |

* cited by examiner

SOLE AND SHOE

REFERENCE TO RELATED APPLICATIONS

This nonprovisional application is based on Japanese Patent Application No. 2022-171333 filed on Oct. 26, 2022 with the Japan Patent Office, the entire contents of which are hereby incorporated by reference.

BACKGROUND

Technical Field

The present disclosure relates to a sole and a shoe.

Background Information

Shoes each having a plate provided in a midsole have conventionally been known. For example, U.S. Pat. No. 9,833,038 discloses a sole structure including an upper midsole member, a lower midsole member, and a plate. The upper midsole member has a top surface, a bottom surface, and a through hole. The lower midsole member has: a top surface being in contact with a bottom surface of the upper midsole member; and a protruding portion protruding from the top surface and located inside the through hole of the upper midsole member. The protruding portion has a top surface flush with the top surface of the upper midsole member. The plate is in contact with the top surface of the upper midsole member and the top surface of the protruding portion. The plate is bonded to the top surface of the protruding portion but not bonded to the top surface of the upper midsole member.

SUMMARY

In order to ensure the force of a foot stepping on the ground while pushing off the ground, shoes used for exercises involving actions such as running are preferred to suppress excessive compression (sinking) of a sole occurring when the foot pushes off the ground. Thus, it is conceivable to increase the hardness of the sole, which however may increase the impact applied particularly when a foot lands on the ground.

It is an object of the present disclosure to provide a sole and a shoe that are capable of achieving both reduction of an impact applied when a foot lands on the ground and suppression of excessive compression of the sole occurring when a foot pushes off the ground.

A sole according to one aspect of the present disclosure includes: a sole body; an elastic portion formed of an elastic body and disposed adjacent to the sole body; a surrounding member that surrounds the elastic portion, the surrounding member being made of a material higher in elastic modulus than a material forming the elastic portion; and a pressing member fixed to the surrounding member in a state in which the pressing member presses the elastic portion in a thickness direction of the sole body, tensile rigidity of the surrounding member in the thickness direction is higher than compression rigidity of the elastic portion in the thickness direction and higher than compression rigidity of the surrounding member in the thickness direction, an uncompressed thickness denotes a thickness of the elastic portion in an uncompressed state in which a compressive load including pressing force applied by the pressing member does not act on the elastic portion, an initial thickness denotes a thickness of the surrounding member in an initial state in which a load in the thickness direction does not act on the surrounding member, the uncompressed thickness is larger than the initial thickness, a reference thickness denotes a thickness of the elastic portion and the surrounding member in a state in which the elastic portion receives the pressing force applied by the pressing member and the surrounding member receives a tensile load from the pressing member such that a top surface of the elastic portion is flush with a top surface of the surrounding member and in an unloaded state in which a load from a wearer does not act on the elastic portion and the surrounding member, and the reference thickness is smaller than the uncompressed thickness of the elastic portion and larger than the initial thickness of the surrounding member.

Further, a shoe according to one aspect of the present disclosure includes: the sole; and an upper connected to the sole to form, together with the sole, a space that accommodates a foot of the wearer.

The foregoing and other objects, features, aspects and advantages of the present disclosure will become apparent from the following detailed description of the present disclosure when taken in conjunction with the accompanying drawings.

DETAIL DESCRIPTION

Figure 1:
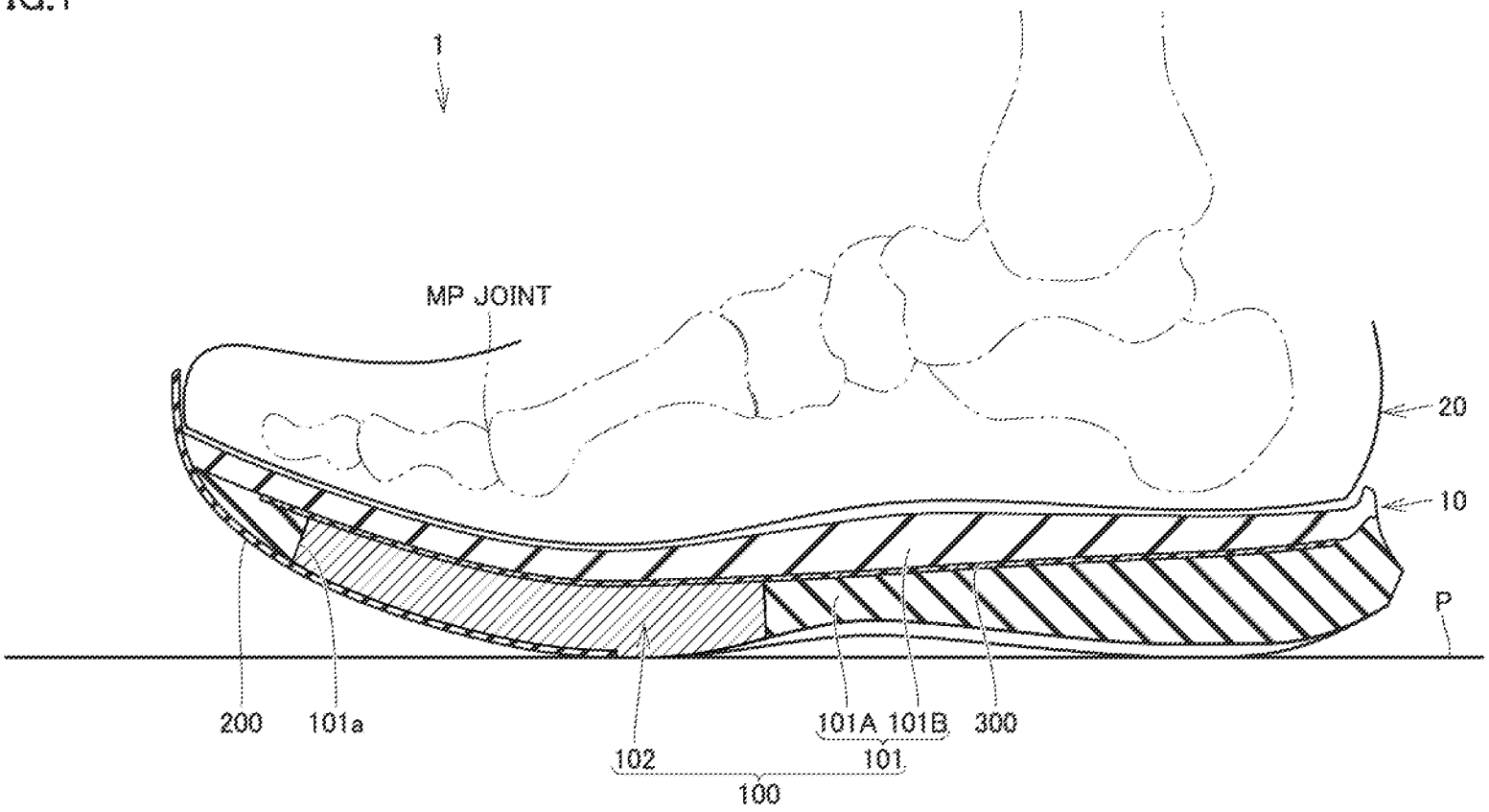
FIG. 1 is a cross-sectional view schematically showing a shoe including a sole according to an embodiment of the present disclosure.

Embodiments of the present disclosure will be hereinafter described with reference to the accompanying drawings. In the accompanying drawings referred to below, the same or corresponding members are denoted by the same reference characters. In the following description, terms such as a foot length direction, a foot width direction, front, and rear are used. Each of these terms representing directions indicates the direction as seen from a viewpoint of a wearer of a shoe 1 placed on a flat plane P (see FIG. 1) such as the ground. For example, front refers to the side toward a toe and rear refers to the side toward a heel. Further, the inner side or the medial foot side refers to the first-toe side of a foot in the foot width direction, and the outer side or the lateral foot side refers to the fifth-toe side of the foot in the foot width direction.

Figure 2:
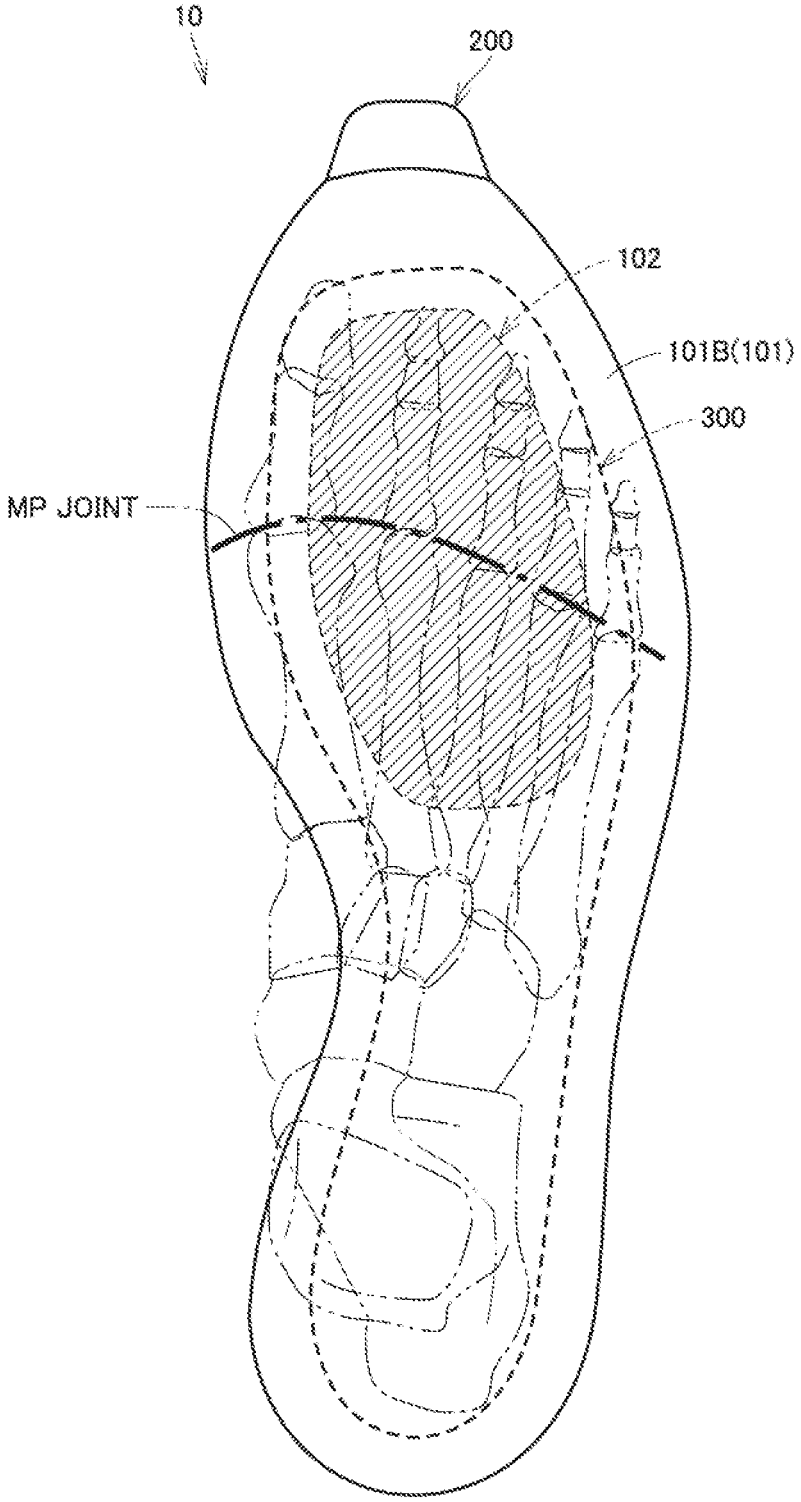
FIG. 2 is a plan view of the sole.

FIG. 1 is a cross-sectional view schematically showing a shoe including a sole according to an embodiment of the present disclosure. FIG. 2 is a plan view of the sole. While FIG. 2 shows a sole 10 for a right foot, this sole 10 is also applicable to a left foot. In this case, the sole for a left foot is formed in a shape in bilateral symmetry with the sole for a right foot, or in a shape nearly identical thereto. The shoe 1 in the present embodiment is suitable for use as a running shoe, for example. The use of the shoe 1, however, is not limited thereto.

As shown in FIG. 1, the shoe 1 includes a sole 10 and an upper 20.

The upper 20 is connected to the sole 10. The upper 20 and the sole 10 together form a space in which a foot of a wearer is accommodated. The upper 20 covers a top surface of the foot of the wearer. An insole (not shown) may be connected below the upper 20.

The sole 10 forms a part of the shoe 1. The sole 10 is connected to a lower part of the upper 20. As shown in FIGS. 1 and 2, the sole 10 includes a midsole 100, an outsole 200, and a pressing member 300.

The midsole 100 includes a sole body 101 and a structure body 102.

The sole body 101 has a shock absorbing function and the like executed when a foot lands on the ground. The sole body 101 is preferably made of a resin material or a rubber material having appropriate strength and excellent shock absorbing performance. The sole body 101 is formed, for example, of a resin-made foam material containing: a resin material as a main component; and a foaming agent and a cross-linking agent as sub-components.

As shown in FIG. 1, the sole body 101 includes a lower midsole 101A and an upper midsole 101B. The lower midsole 101A forms a lower part of the sole body 101. The upper midsole 101B is disposed on the lower midsole 101A. The upper midsole 101B forms an upper part of the sole body 101. The upper 20 is connected to the upper midsole 101B.

The outsole 200 is connected to a bottom surface of the sole body 101. More specifically, the outsole 200 is connected to a bottom surface of the lower midsole 101A. The outsole 200 is made of rubber, resin, or the like. The outsole 200 may cover the entire bottom surface of the lower midsole 101A or may cover only a part of the bottom surface of the lower midsole 101A as shown in FIG. 1.

The structure body 102 has a function of suppressing excessive compression of the sole 10 particularly when a foot pushes off the ground. The structure body 102 is disposed adjacent to the sole body 101. In the present embodiment, the lower midsole 101A is provided with an accommodation portion 101*a* (see FIG. 1), and the structure body 102 is disposed inside the accommodation portion 101*a*. The accommodation portion 101*a* is opened upward.

As shown in FIGS. 1 and 2, the structure body 102 is disposed in a range extending, in the foot length direction (in an up-down direction in FIG. 2), over a portion overlapping with a metatarsophalangeal (MP) joint of a foot of a wearer in a thickness direction of the sole body 101. As shown in FIG. 2, the structural body 102 is disposed in a central portion in the foot width direction (in a left-right direction in FIG. 2). The structure body 102 is disposed in a range overlapping with the first distal phalanx to the third distal phalanx in the thickness direction and overlapping with the first proximal phalanx to the fourth proximal phalanx in the thickness direction. Further, the structure body 102 is disposed in a range overlapping with each of the metatarsal bones in the thickness direction.

Figure 3:
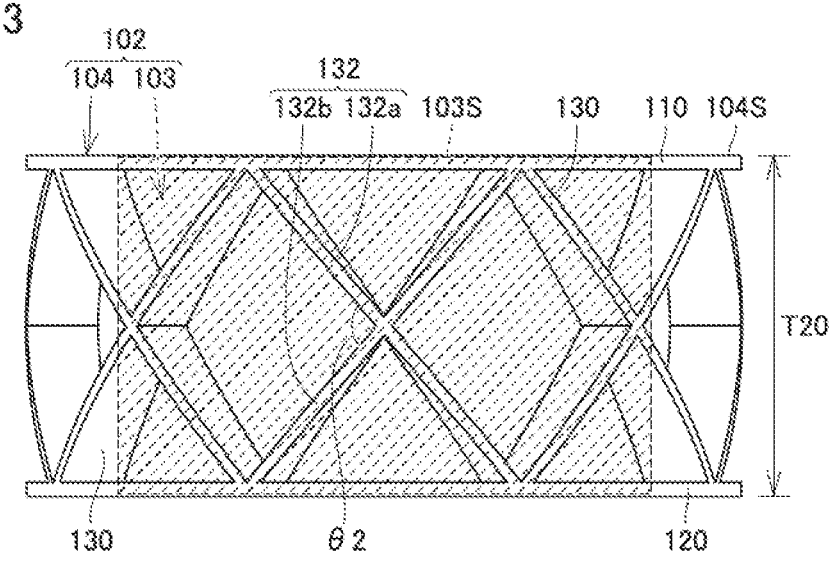
FIG. 3 is a front view of a structure body in an unloaded state.
Figure 4:
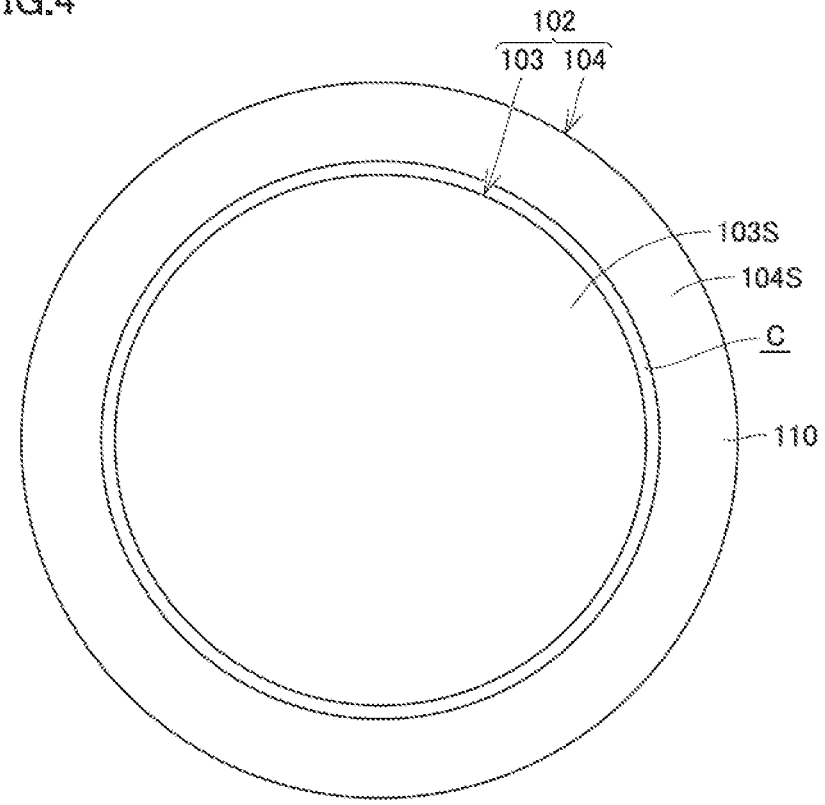
FIG. 4 is a plan view of the structure body in the unloaded state.

As shown in FIGS. 3 and 4, the structure body 102 includes an elastic portion 103 and a surrounding member 104. In FIG. 3, the elastic portion 103 is indicated by a broken line.

The elastic portion 103 is formed of an elastic body. The elastic portion 103 may be made of the same material as that of the sole body 101, or may be made of a material different from the material of the sole body 101. The elastic portion 103 may be fabricated by a stereolithography-type three-dimensional additive manufacturing method. The Poisson's ratio of the elastic portion 103 is preferably set to be equal to or less than 0.2. The Poisson's ratio is a value obtained by dividing the strain in the foot width direction by the strain in the thickness direction.

A top surface 103S of the elastic portion 103 may have an uneven shape (protrusions and recesses). In this case, in the elastic portion 103, the compression rigidity is high in protruding portions and low in recessed portions. Thus, for example, by configuring the elastic portion 103 such that the compression rigidity is relatively low in its central region and relatively high in its peripheral region, the compressive load acting on the elastic portion 103 during running can be concentrated at an ideal position.

As shown in FIGS. 3 and 4, the surrounding member 104 surrounds the elastic portion 103. The surrounding member 104 is made of a material higher in elastic modulus than the material forming the elastic portion 103. FIG. 4 shows an example in which the outer shapes of the elastic portion 103 and the surrounding member 104 are circular in a plan view, but the outer shapes of the elastic portion 103 and the surrounding member 104 are not limited to circular in a plan view. The outer shape of the elastic portion 103 may be elliptical in a plan view.

The following describes the pressing member 300. The pressing member 300 is fixed to the surrounding member 104 while pressing the elastic portion 103 in its thickness direction. In the present embodiment, as shown in FIG. 1, the pressing member 300 is disposed between the lower midsole 101A and the upper midsole 101B. As shown in FIG. 2, in a plan view, the outer shape of the pressing member 300 is larger than the outer shape of the surrounding member 104.

As shown in FIGS. 1 and 2, the pressing member 300 is fixed to the lower midsole 101A and the surrounding member 104 so as to extend, in the foot length direction (in the up-down direction in FIG. 2), over a position overlapping with the MP joint of the wearer's foot in the thickness direction. In the present embodiment, the pressing member 300 has a shape extending in the foot length direction so as to extend in the thickness direction from a region supporting a toe of the wearer to a region supporting a calcaneus of the wearer. Note that the pressing member 300 should only have a shape capable of pressing the elastic portion 103 and may also be partially provided with a through hole or the like.

The pressing member 300 is made of a material higher in hardness than the sole body 101. The pressing member 300 also has a function of increasing the flexural rigidity of the sole body 101, a function of uniformly applying a load onto the sole body 101, and the like. The pressing member 300 is made of a fiber reinforced resin or a non-fiber reinforced resin. Examples of the fiber used for the fiber reinforced resin include carbon fibers, glass fibers, aramid fibers, Dyneema® fibers, Zylon® fibers, boron fibers, and the like. Examples of the non-fiber reinforced resin include polymer resins such as polyurethane-based thermoplastic elastomer (TPU) and amide-based thermoplastic elastomer (TPA). The pressing member 300 is preferably made of a fiber reinforced plastic containing a synthetic resin and the above-mentioned fibers, and more preferably made of a carbon fiber reinforced plastic containing a synthetic resin and carbon fibers.

Figure 5:
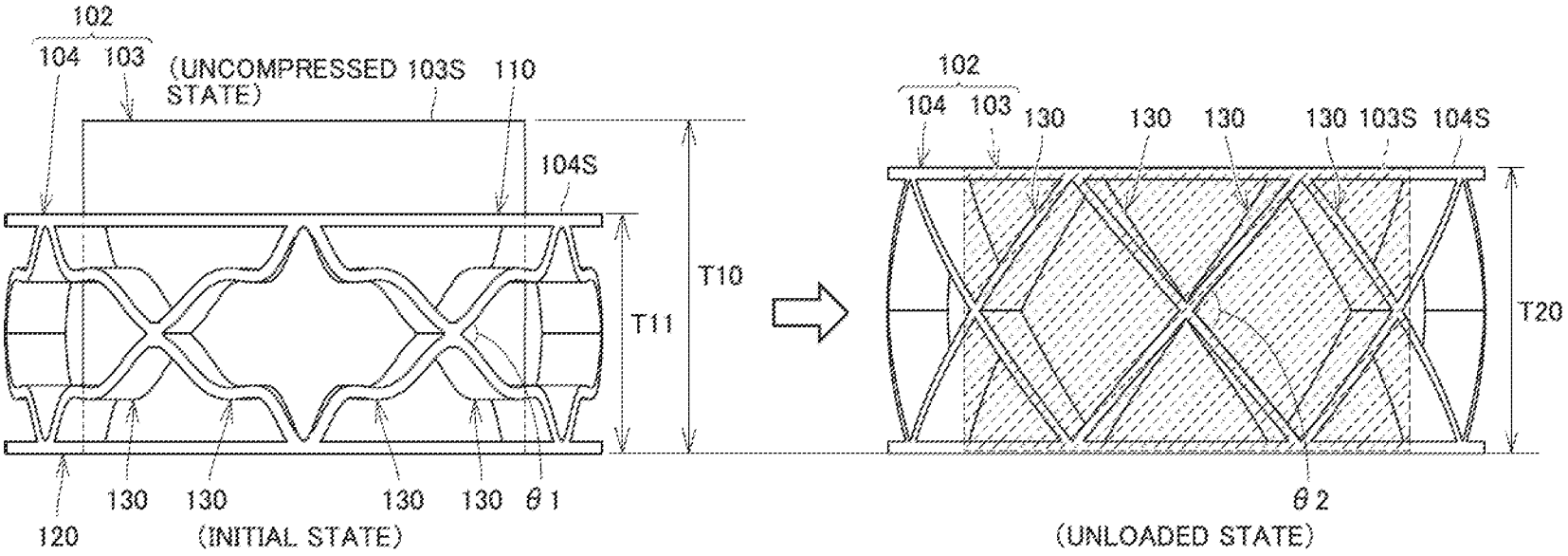
FIG. 5 is a front view schematically showing states before and after an elastic portion and a surrounding member are integrated.

FIG. 5 shows the states before and after the elastic portion 103 and the surrounding member 104 are integrated. The elastic portion 103 and the surrounding member 104 are integrated by fixing the pressing member 300 to the surrounding member 104 in the state in which the pressing member 300 presses the elastic portion 103 in the thickness direction. Note that FIG. 5 does not show the pressing member 300.

In the following description, an "uncompressed state" means the state of the elastic portion 103 before the elastic portion 103 is integrated with the surrounding member 104 (the state on the left side in FIG. 5), i.e., the state of the elastic portion 103 in which a compressive load including pressing force applied by the pressing member 300 does not act on the elastic portion 103. Also, an "initial state" means the state of the surrounding member 104 before the surrounding member 104 is integrated with the elastic portion 103 (the state on the left side in FIG. 5), i.e., the state of the surrounding member 104 in which the load in the thickness direction does not act on the surrounding member 104. Further, an "unloaded state" means the state of the elastic portion 103 and the surrounding member 104 that have been integrated (the state on the right side in FIG. 5), i.e., the state in which: the elastic portion 103 receives the pressing force applied by the pressing member 300 and the surrounding member 104 receives a tensile load from the pressing member 300 such that the top surface 103S of the elastic portion 103 is flush with a top surface 104S of the surrounding member 104; and the load from the wearer does not act on the elastic portion 103 and the surrounding member 104. FIGS. 3 and 4 show the structure body 102 in the unloaded state.

The top surface 103S of the elastic portion 103 in the uncompressed state protrudes upward from the top surface of the lower midsole 101A in the sole body 101. The pressing member 300 is fixed to the top surface of the lower midsole 101A and the top surface 104S of the surrounding member 104 in the state in which the pressing member 300 presses the elastic portion 103 in the unloaded state. In other words, the elastic portion 103 is disposed in the sole body 101 in the state in which the elastic portion 103 in an uncompressed state is compressed in the thickness direction. Note that the bottom surface of the elastic portion 103 in the uncompressed state may protrude below the bottom surface of the lower midsole 101A, and the pressing member 300 may be fixed to the bottom surface of the lower midsole 101A and the bottom surface of the surrounding member 104 in the state in which the pressing member 300 presses the elastic portion 103 in the unloaded state.

The top surface 103S of the elastic portion 103 may be or may not be bonded to the pressing member 300. In the case where the return speed (the return value) of the surrounding member 104 is higher (stronger) than that of the elastic portion 103 when the elastic portion 103 is not bonded to the pressing member 300 and the structure body 102 returns from its compressed state, the return speed of the elastic portion 103 is increased via the pressing member 300 since the elastic portion 103 is bonded to the pressing member 300. Further, since the elastic portion 103 is bonded to the pressing member 300, the force other than compression, for example, the rigidity in the shear direction in the front-rear direction, can be ensured. Further, the elastic portion 103 is kept fixed at a predetermined position.

On the other hand, when the elastic portion 103 is not bonded to the pressing member 300, the top surface 103S of the elastic portion 103 can be provided with a surface shape according to the degree of compression. For example, by providing the top surface 103S with an uneven shape or a corrugated shape, the degree of compression in the elastic portion 103 can be changed, which makes it easy to achieve a design, for example, for dispersing the pressure during running. In addition, since the pressing member 300 and the elastic portion 103 are deformed independently of each other when they are bent while the wearer is running, the flexural rigidity of the sole 10 is lower than that in the case where the elastic portion 103 is bonded to the pressing member 300. Thus, the wearer tends to feel less uncomfortable.

As shown in FIG. 5, an uncompressed thickness T10 as a thickness of the elastic portion 103 in the uncompressed state is larger than an initial thickness T11 as a thickness of the surrounding member 104 in the initial state. A reference thickness T20 as a thickness of the elastic portion 103 and the surrounding member 104 in the unloaded state is smaller than the uncompressed thickness T10 of the elastic portion 103 and larger than the initial thickness T11 of the surrounding member 104.

FIG. 4 is a plan view of the structure body 102 in the unloaded state. As shown in FIG. 4, a gap C is provided between the elastic portion 103 and the surrounding member 104 in the unloaded state. Providing the gap C can reduce an energy loss caused by the contact between the elastic portion 103 and the surrounding member 104.

Figure 6:
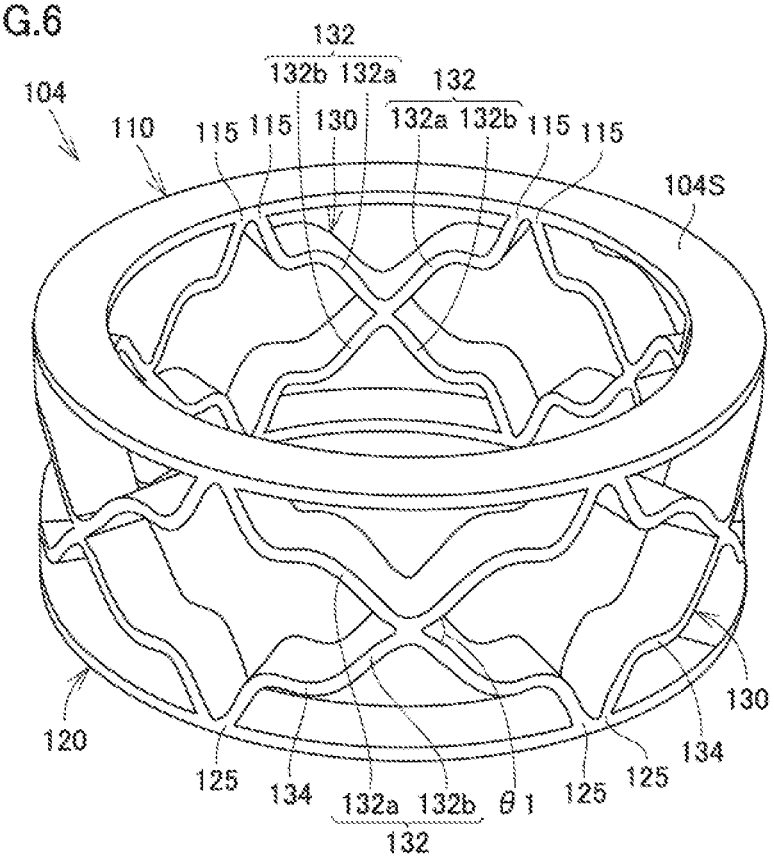
FIG. 6 is a perspective view of the surrounding member in an initial state.
Figure 7:
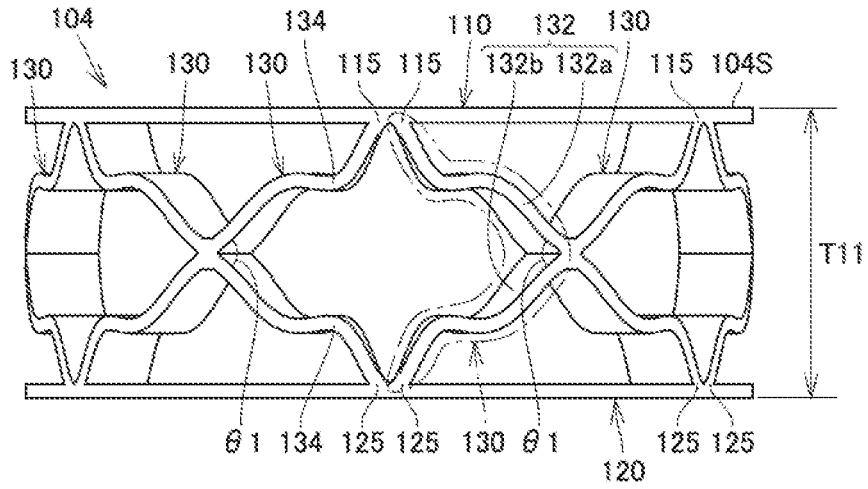
FIG. 7 is a front view of the surrounding member in the initial state.

FIGS. 6 and 7 each show the surrounding member 104 in the initial state. As shown in FIGS. 6 and 7, the surrounding member 104 includes a first frame portion 110, a second frame portion 120, and a plurality of coupling portions 130.

The first frame portion 110 is formed in a frame shape. In the present embodiment, the first frame portion 110 is formed in an annular continuous shape. However, the first frame portion 110 may not be annularly continuous. The top surface 104S of the first frame portion 110 is fixed to the pressing member 300 by adhesion or the like.

The second frame portion 120 is disposed below the first frame portion 110. In the present embodiment, the second frame portion 120 is also formed in an annular continuous shape. However, the second frame portion 120 also may not be annularly continuous. The second frame portion 120 is preferably formed in the same shape as that of the first frame portion 110. The second frame portion 120 is fixed to the outsole 200 by adhesion or the like.

Each coupling portion 130 couples the first frame portion 110 to the second frame portion 120. Each coupling portion 130 is formed in a plate shape. As shown in FIG. 4, the plurality of coupling portions 130 each has a shape falling within a projection plane of the first frame portion 110. The gap C is provided between: the elastic portion 103 in the unloaded state; and the first frame portion 110 and the plurality of coupling portions 130 in the unloaded state.

As shown in FIGS. 6 and 7, at least two coupling portions 130 of the plurality of coupling portions 130 and the first frame portion 110 are connected at a first connecting portion 115, and a plurality of the first connecting portions 115 are arranged at intervals in the circumferential direction of the first frame portion 110. At least two coupling portions 130 of the plurality of coupling portions 130 and the second frame portion 120 are connected at a second connecting portion 125, and a plurality of the second connecting portions 125 are arranged at intervals in the circumferential direction of the second frame portion 120.

Each of the coupling portions 130 includes at least one folded portion 132 provided between the first frame portion 110 and the second frame portion 120. In the present embodiment, each coupling portion 130 has a single folded portion 132. However, each coupling portion 130 may have a plurality of folded portions 132. The folded portion 132 includes a first folded piece 132*a* and a second folded piece 132*b*.

The first folded piece 132*a* has a shape extending gradually downward toward one side (for example, the right side in FIG. 7) in the circumferential direction.

The second folded piece 132*b* has a shape extending gradually downward from a lower end portion of the first folded piece 132*a* toward the other side (for example, the left side in FIG. 7) in the circumferential direction.

An angled portion formed by the first folded piece 132*a* and the second folded piece 132*b* points in the direction along the circumferential direction of the first frame portion 110. Thus, the plurality of coupling portions 130 are compressed within the projection plane of the first frame portion 110.

As shown in FIGS. 6 and 7, the folded portions 132 adjacent to each other in the circumferential direction, more specifically, the angled portions each formed by the first folded piece 132*a* and the second folded piece 132*b*, are joined to each other.

An angle θ1 (see FIGS. 5 and 7) formed by the first folded piece 132*a* and the second folded piece 132*b* in the initial state is smaller than an angle θ2 (see FIGS. 3 and 5) formed by the first folded piece 132*a* and the second folded piece 132*b* in the unloaded state. The angle θ1 may be formed as an acute angle.

Figure 8:
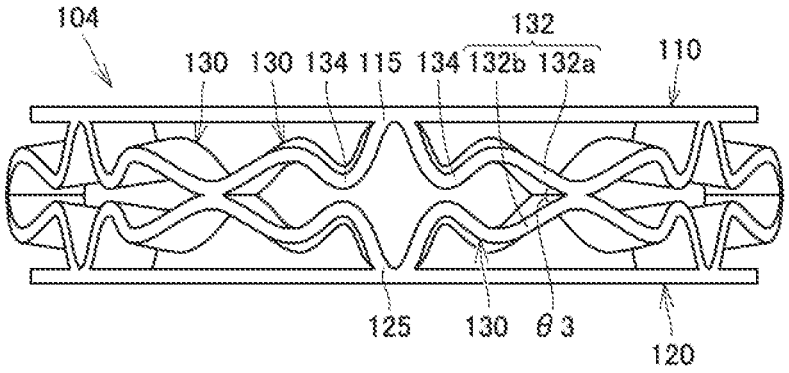
FIG. 8 is a front view of the structure body in a state compressed from the unloaded state.

As shown in FIGS. 6 to 8, each coupling portion 130 includes a bent portion 134. FIG. 8 is a front view of the structure body 102 in the compressed state. When a load (a compressive load) from the wearer acts on the structure body 102, each coupling portion 130 curves from the bent portion 134 as a starting point as shown in FIG. 8. On the other hand, the bent portion 134 is extended between the initial state and the unloaded state or in the unloaded state. As the direction in which the bent portion 134 deforms is more coincident with the direction in which the load acts on the bent portion 134, the rigidity of the coupling portion 130 becomes higher. Thus, the compression rigidity of the surrounding member 104 is lower than the tensile rigidity of the surrounding member 104.

An angle θ3 (see FIG. 8) formed by the first folded piece 132*a* and the second folded piece 132*b* of the structure body 102 in the compressed state is smaller than the angle θ1. The angle θ3 gradually becomes smaller as the structure body 102 is compressed. As the angle θ3 becomes smaller, i.e., as the amount of compressive deformation of each coupling portion 130 becomes larger, the compression rigidity of the surrounding member 104 becomes smaller.

Figure 9:
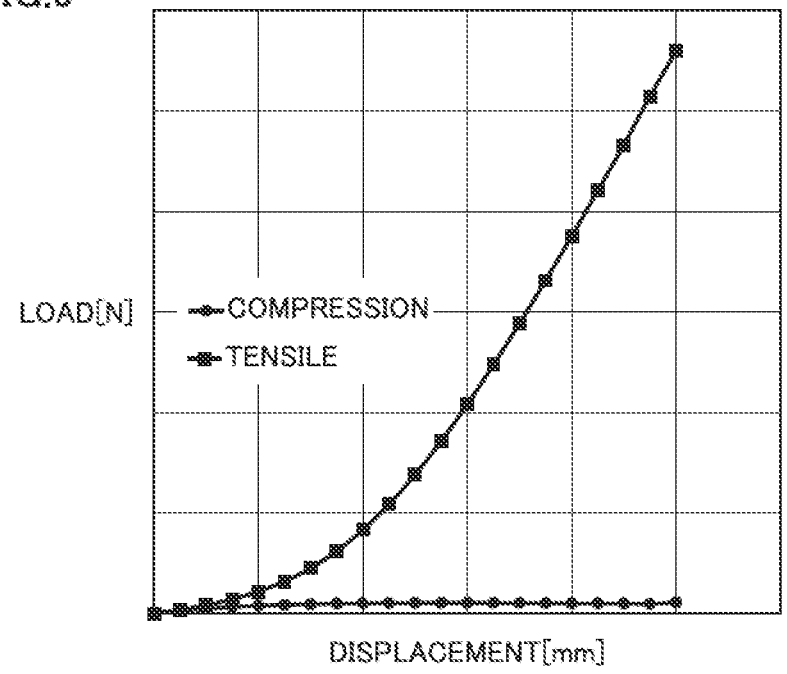
FIG. 9 is a graph showing a relation between a displacement of the surrounding member in a thickness direction and a load input to the surrounding member in each of a compression direction and a tensile direction.

FIG. 9 is a graph showing the relation between the displacement of the surrounding member 104 in the thickness direction and the load input to the surrounding member 104 in each of the compression direction and the tensile direction. As shown in FIG. 9, the tensile rigidity of the surrounding member 104 in the thickness direction is higher than the compression rigidity of the surrounding member 104 in the thickness direction. The tensile rigidity of the surrounding member 104 in the thickness direction is higher than the compression rigidity of the elastic portion 103 in the thickness direction.

As described above, in the sole 10 according to the present embodiment, the impact caused when the foot lands on the ground is effectively absorbed by the sole body 101, and the elastic portion 103 that is being compressed from the uncompressed state to the unloaded state is disposed, so that excessive compression (sinking) of the sole 10 occurring when the foot pushes off the ground is suppressed.

Further, since the surrounding member 104 having tensile rigidity higher than the compression rigidity of the elastic portion 103 surrounds the elastic portion 103, the portion of the sole body 101 that is adjacent to the elastic portion 103 is suppressed from being pulled by the restoring force of the elastic portion 103 (the force with which the elastic portion 103 returns from the unloaded state to the uncompressed state).

In addition, the compression rigidity of the surrounding member 104 is lower than the tensile rigidity of the surrounding member 104, which allows effective reduction of the reaction force that is received by the wearer from the surrounding member 104 when the wearer's foot lands on or pushes off the ground.

The following describes modifications of the above-described embodiment with reference to FIGS. 10 to 23.

First Modification

Figure 10:
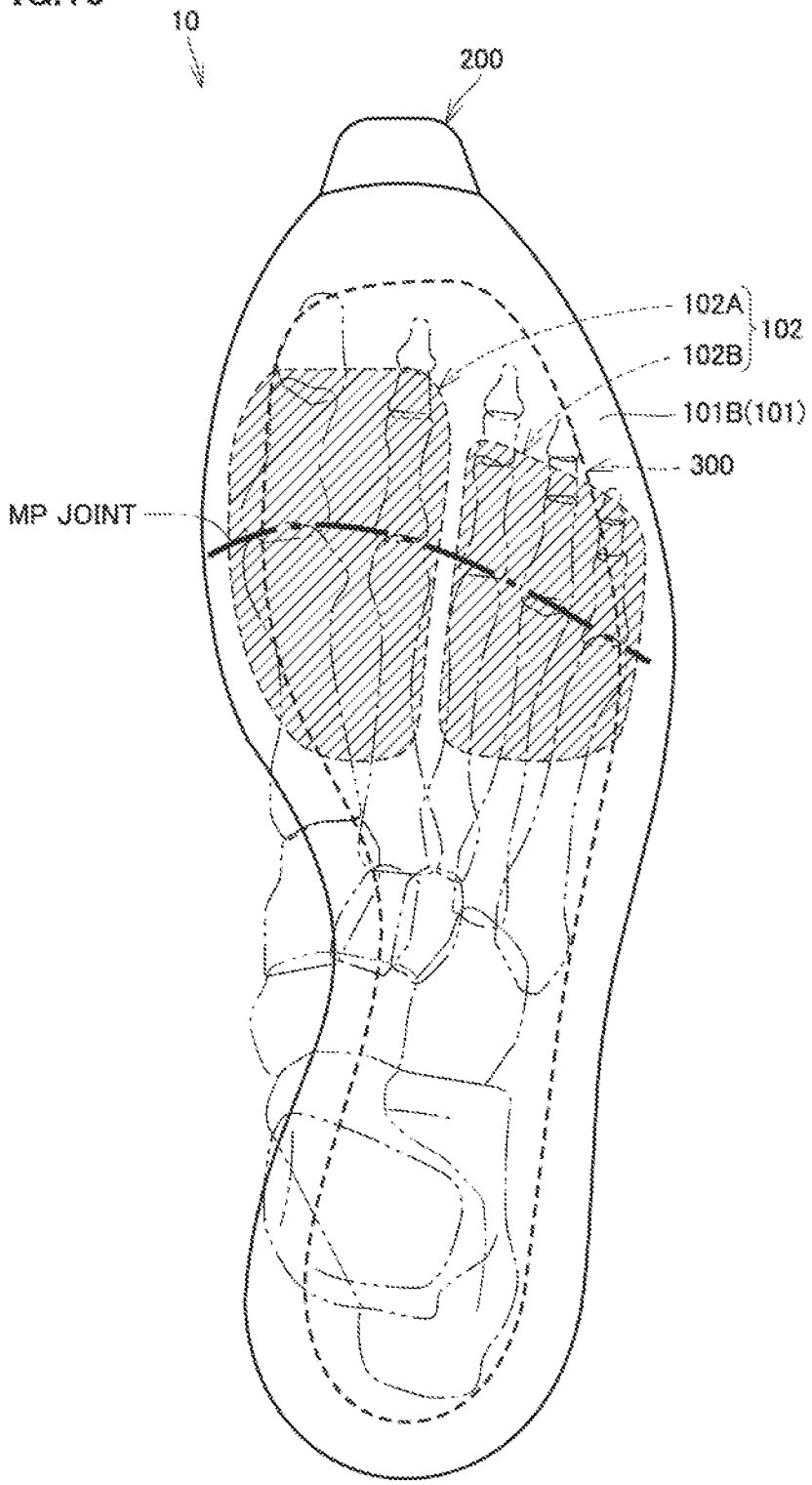
FIG. 10 is a plan view schematically showing a modification of an arrangement of the structure body on a sole body.

As shown in FIG. 10, the structure body 102 may include a medial foot side structure portion 102A and a lateral foot side structure portion 102B disposed to be spaced apart from each other in the foot width direction.

The front end of the medial foot side structure portion 102A is disposed in a range overlapping with the first distal phalanx and the second middle phalanx in the thickness direction. The rear end of the medial foot side structure portion 102A is disposed in a range overlapping with the central portion of the first metatarsal bone and the central portion of the second metatarsal bone in the thickness direction.

The front end of the lateral foot side structure portion 102B is disposed in a range overlapping with the third middle phalanx, the fourth middle phalanx, and the fifth distal phalanx in the thickness direction. The rear end of the lateral foot side structure portion 102B is disposed in a range overlapping with the central portion of the third metatarsal bone, the central portion of the fourth metatarsal bone, and the central portion of the fifth metatarsal bone in the thickness direction.

The outer end portion of the medial foot side structure portion 102A in the foot width direction and the inner end portion of the lateral foot side structure portion 102B in the foot width direction are disposed at positions overlapping with the portion between the second toe and the third toe of the wearer's foot in the thickness direction.

When the structure body 102 has a plurality of structure portions, these structure portions may be formed of different surrounding members 104 or of the elastic portions 103 having different elastic moduli depending on the locations where the respective structure portions are disposed. For example, a larger load is more likely to occur on the medial foot side than on the lateral foot side when the foot pushes off the ground, and the foot generally lands on the ground from its lateral foot side during running. Thus, the medial foot side structure portion 102A may be provided with the elastic portion 103 having a relatively high elastic modulus so as to suppress excessive compressive deformation, and the lateral foot side structure portion 102B may be provided with the elastic portion 103 having a relatively low elastic modulus from the viewpoint of enhancing the shock absorbing performance when the foot lands on the ground. Further, by the configuration in which the lateral foot side structure portion 102B is higher in elastic modulus than the medial foot side structure portion 102A, excessive pronation of the foot occurring after the foot lands on the ground is suppressed.

Second Modification

Figure 11:
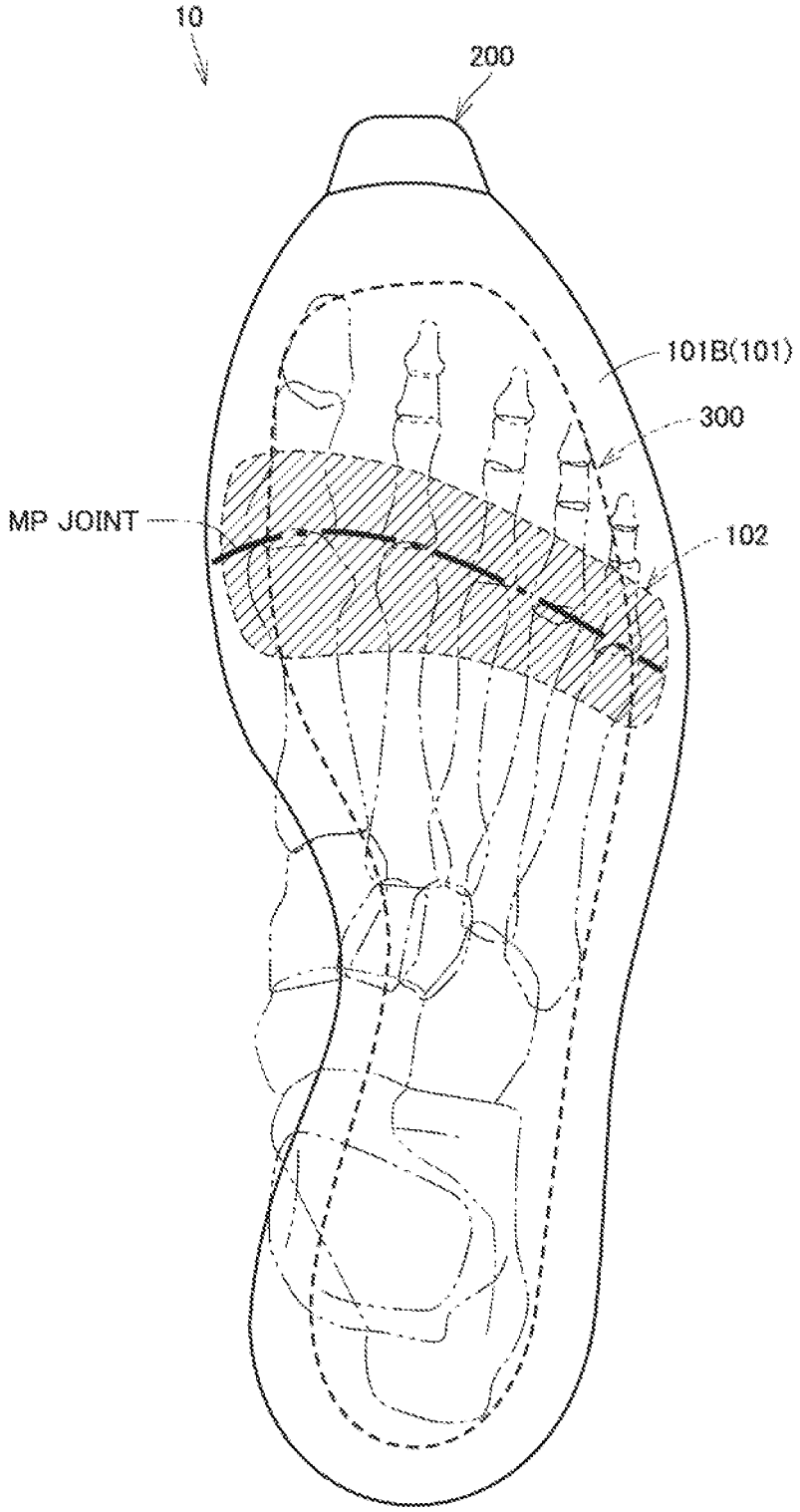
FIG. 11 is a plan view schematically showing a modification of the arrangement of the structure body on the sole body.

As shown in FIG. 11, the front end of the structure body 102 may be disposed at a position overlapping with the diaphysis of each proximal phalanx in the thickness direction, and the rear end of the structure body 102 may be disposed at a position overlapping with the diaphysis of each metatarsal bone in the thickness direction. While a compressive load occurs directly below a portion between the diaphysis of each proximal phalanx and the diaphysis of each metatarsal bone in the phase during which the foot pushes off the ground during running, the structure body 102 disposed in this portion suppresses excessive deformation of the sole 10 and thereby provides stability.

Third Modification

Figure 12:
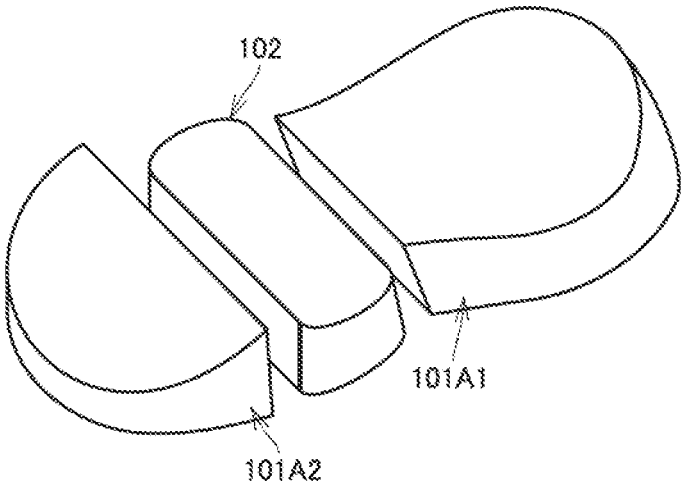
FIG. 12 is a perspective view schematically showing a modification of the arrangement of the structure body on the sole body.

As shown in FIG. 12, both end portions of the structure body 102 in the foot width direction may be exposed from the sole body 101, and the lower midsole 101A may be formed of a rear midsole portion 101A1 and a front midsole portion 101A2 separated from each other in the foot length direction with the structure body 102 interposed therebetween.

Fourth Modification

Figure 13:
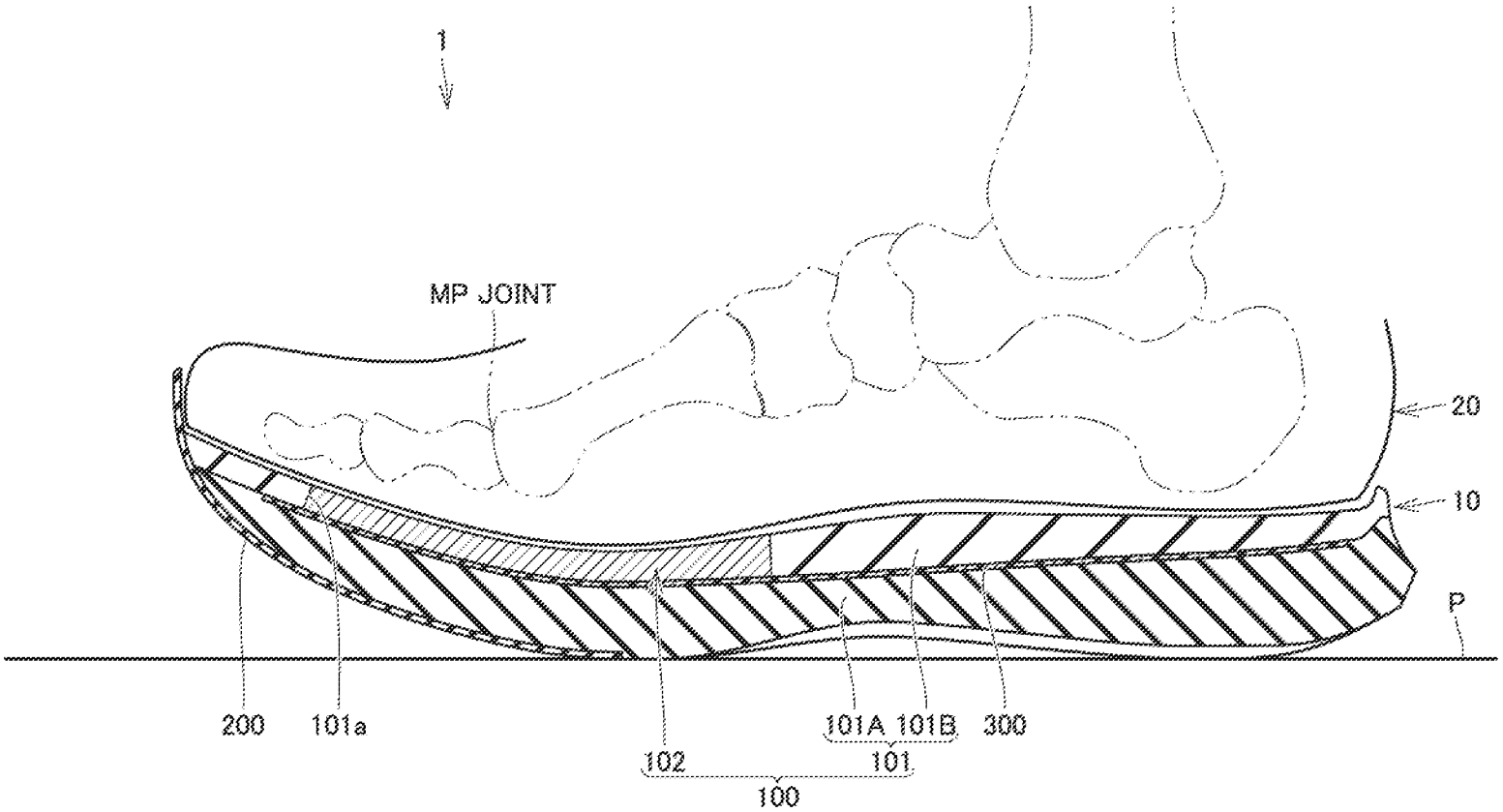
FIG. 13 is a cross-sectional view schematically showing a modification of the arrangement of the structure body on the sole body.

As shown in FIG. 13, the accommodation portion 101*a* may be provided in the upper midsole 101B, and the structure body 102 may be disposed in the accommodation portion 101*a* of the upper midsole 101B. In this case, an insole higher in hardness than the sole body 101 is preferably provided. The insole is formed, for example, by impregnating a nonwoven fabric with a synthetic resin.

Figure 14:
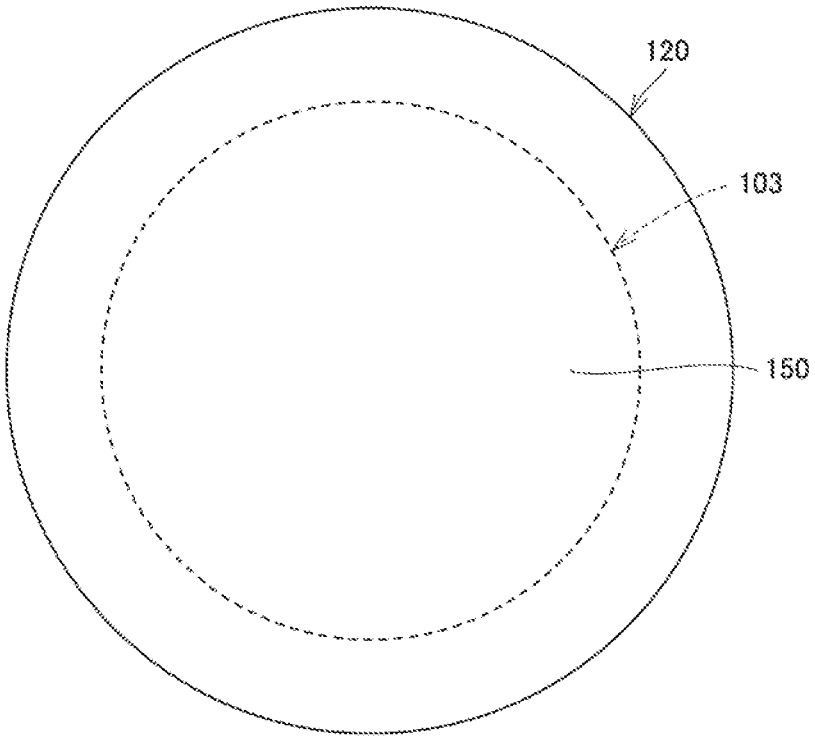
FIG. 14 is a bottom view of a modification of the surrounding member.

In the present example, as shown in FIG. 14, the surrounding member 104 preferably further includes a bottom wall 150 that is connected to the second frame portion 120 to support the elastic portion 103. The second frame portion 120 and the bottom wall 150 are, for example, formed integrally of the same material. Note that FIG. 14 is a bottom view of the structure body 102.

Fifth Modification

Figure 15:
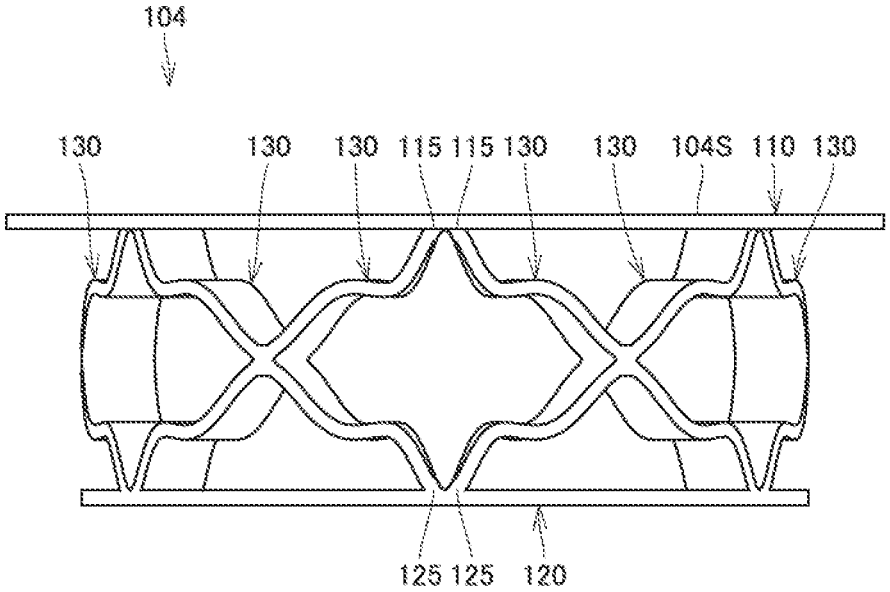
FIG. 15 is a front view of a modification of the surrounding member.

As shown in FIG. 15, the first frame portion 110 may have a shape protruding outward in an orthogonal direction, which is orthogonal to the thickness direction (in the up-down direction in FIG. 15), from the outer edge portion of each of the coupling portions 130 that extends in the orthogonal direction. This ensures a bonding area between the first frame portion 110 and other members.

Sixth Modification

Figure 16:
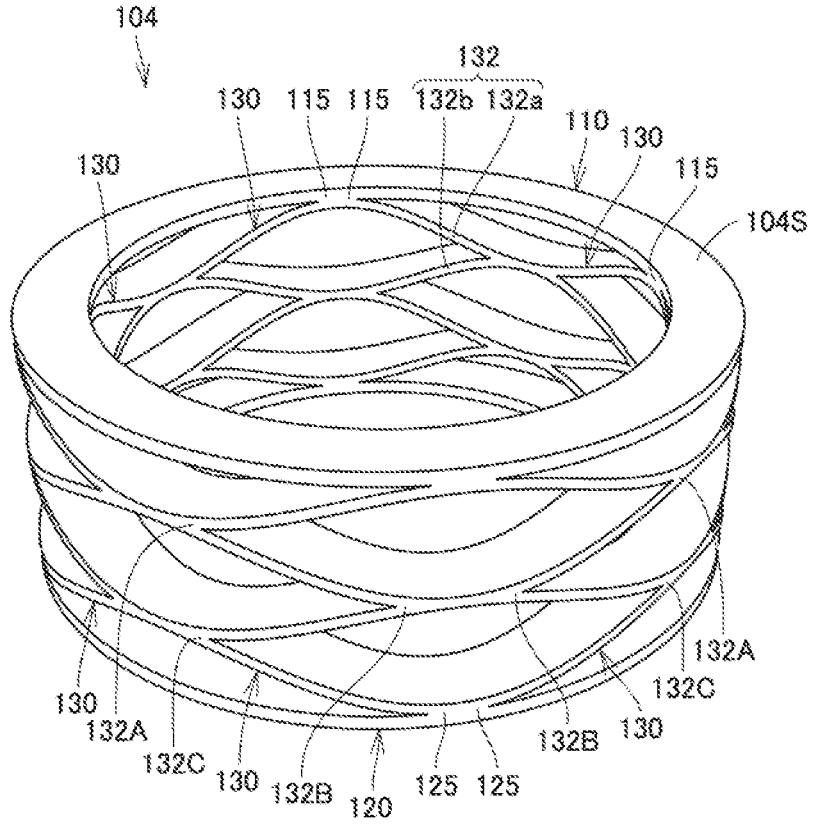
FIG. 16 is a perspective view of a modification of the surrounding member.
Figure 17:
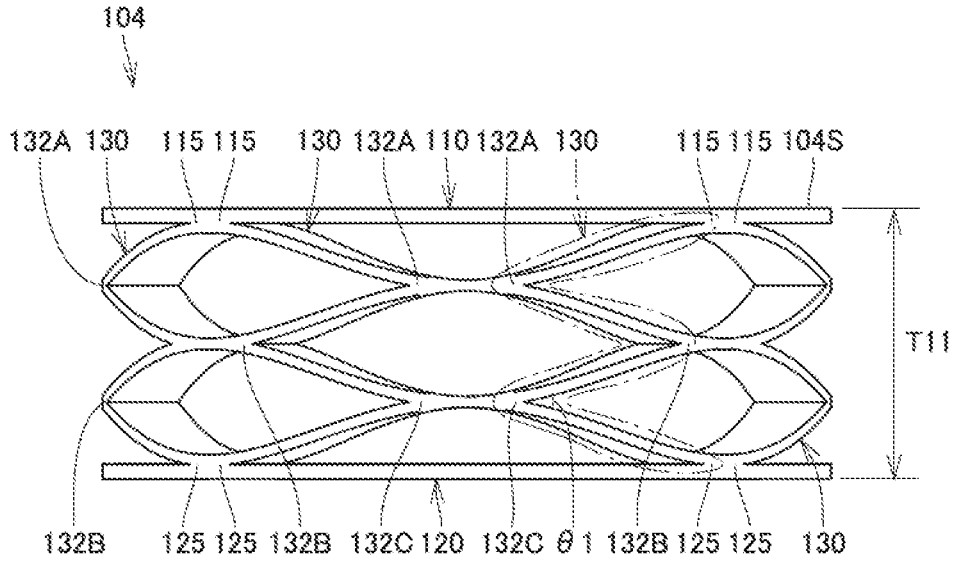
FIG. 17 is a front view of the surrounding member shown in FIG. 16.

As shown in FIGS. 16 and 17, each coupling portion 130 in the surrounding member 104 may have a plurality of folded portions 132. In the example shown in FIGS. 16 and 17, each coupling portion 130 includes three folded portions, i.e., a first folded portion 132A, a second folded portion 132B, and a third folded portion 132C.

The first folded portion 132A, the second folded portion 132B, and the third folded portion 132C are arranged in this order to extend downward in the thickness direction. The angled portions in the first folded portion 132A and the third folded portion 132C point in the same direction in the circumferential direction while the angled portion in the second folded portion 132B points in the direction opposite in the circumferential direction to the direction in which the angled portion in the first folded portion 132A points.

A lower part of the first folded piece 132*a* in the first folded portion 132A has a shape curved to protrude downward, and an upper part of the second folded piece 132*b* in the first folded portion 132A has a shape curved to protrude upward. The same also applies to the second folded portion 132B and the third folded portion 132C.

Seventh Modification

Figure 18:
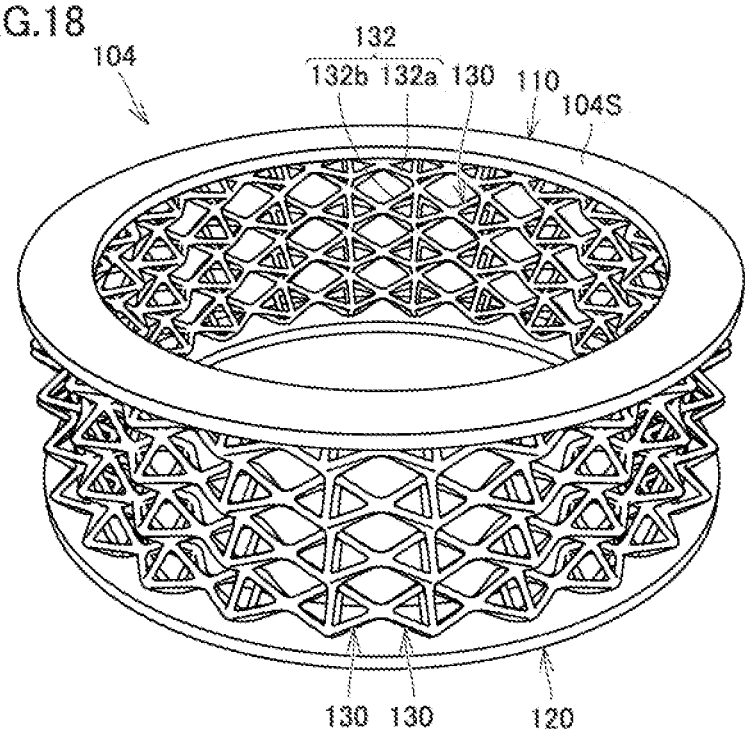
FIG. 18 is a perspective view of a modification of the surrounding member.
Figure 19:
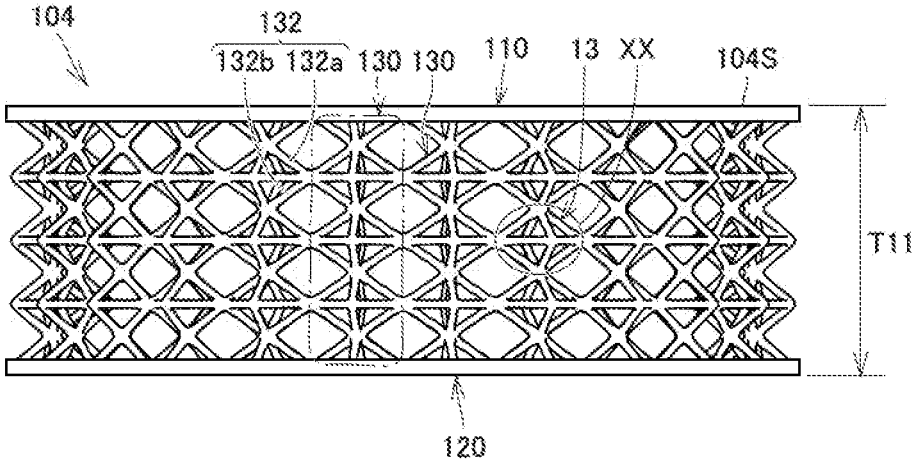
FIG. 19 is a front view of the surrounding member shown in FIG. 18.

As shown in FIGS. 18 and 19, the plurality of coupling portions 130 in the surrounding member 104 may have a three-dimensional lattice structure. The three-dimensional lattice structure shown in each of FIGS. 18 and 19 has a plurality of unit structures 13 (see FIG. 20) repeatedly arranged side by side.

Figure 20:
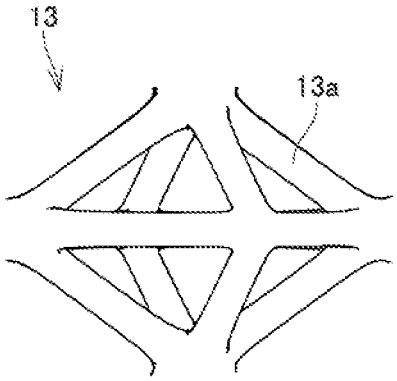
FIG. 20 is an enlarged view of a range indicated by a solid line XX in FIG. 19.

FIG. 20 is an enlarged view of a unit structure 13. As shown in FIG. 20, the unit structure 13 has a three-dimensional lattice structure. A plurality of the unit structures 13 are repeatedly arranged regularly and continuously in each of the circumferential direction and the thickness direction of the first frame portion 110.

The unit structure 13 has a three-dimensional shape in which a plurality of column portions 13*a* extending in respective prescribed directions are connected to each other. The plurality of column portions 13*a* are arranged such that each column portion 13*a* extends to intersect with its adjacent column portion 13*a*, to thereby form a three-dimensional lattice structure. Each column portion 13*a* is formed in a substantially circular cylindrical shape. Each unit structure 13 has what is called a double pyramid lattice structure. The unit space occupied by the unit structure 13 has an octahedral shape.

As the unit structure 13, various structures can also be adopted in addition to the structure shown in FIG. 20, and examples of the unit structure 13 applicable in this case may be various structures such as a rectangular parallelepiped lattice, a diamond lattice, an octahedral lattice, or a lattice obtained by adding various supports to any one of these lattices.

The entire surrounding member 104 and the sole body 101 adjacent thereto may be formed by three-dimensional additive manufacturing. Thereby, the hardness can be gradually changed without producing a step between the structure body 102 and the sole body 101, which makes it possible to prevent the wearer's foot from being pushed upward or from feeling uncomfortable by a sudden change in rigidity. Further, no clear boundary is formed between the surrounding member 104 and the sole body 101, which makes it easy to achieve an expected effect also for various different foot shapes.

Eighth Modification

Figure 21:
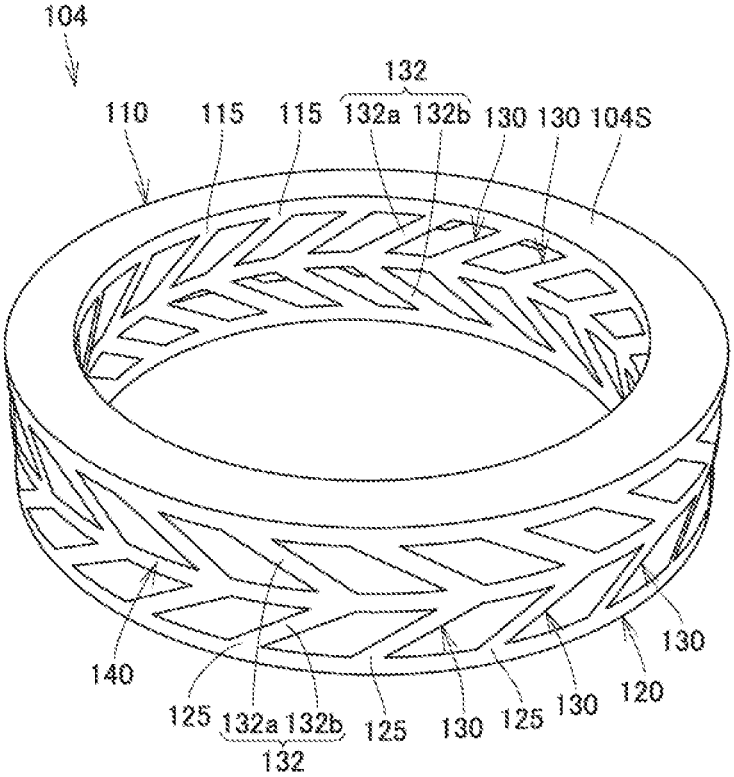
FIG. 21 is a perspective view of a modification of the surrounding member.
Figure 22:
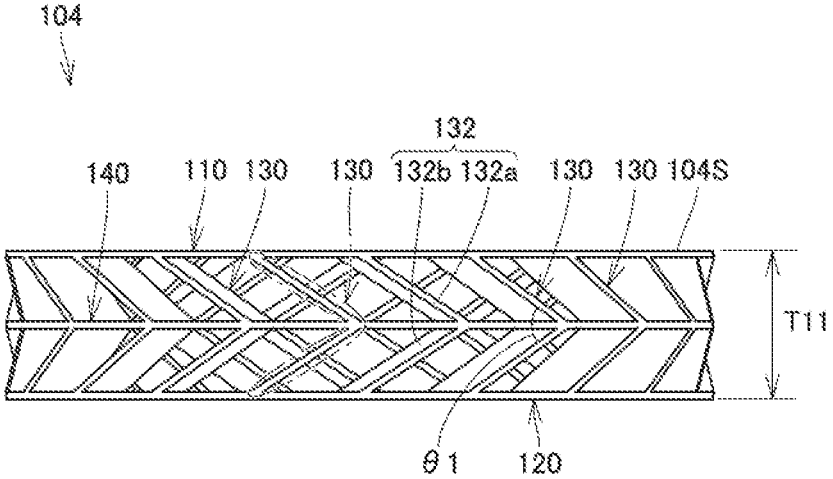
FIG. 22 is a front view of the surrounding member shown in FIG. 21.
Figure 23:
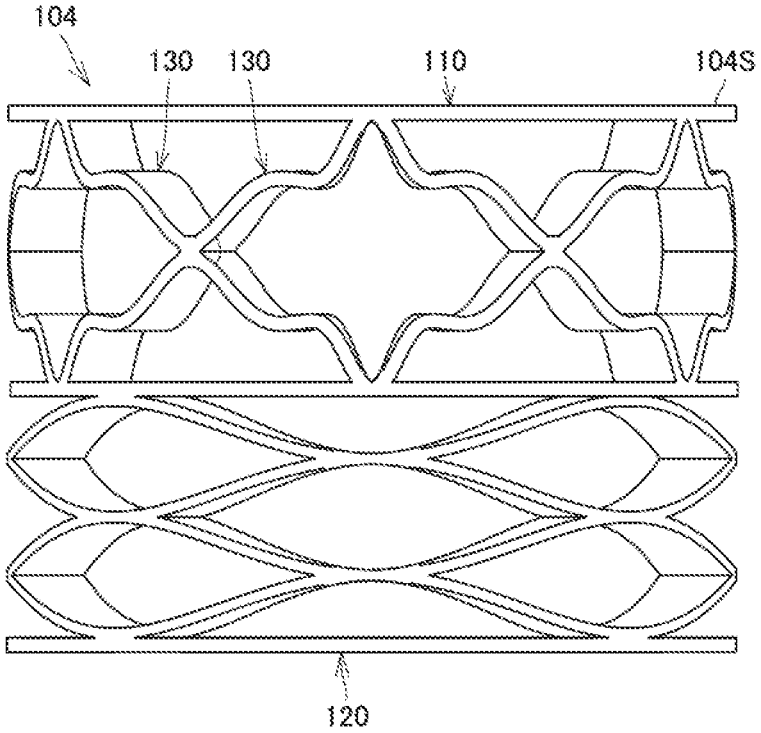
FIG. 23 is a front view of a modification of the surrounding member.

As shown in FIGS. 21 and 22, each of the coupling portions 130 in the surrounding member 104 may be formed of the first folded piece 132*a* and the second folded piece 132*b*. Each of the folded pieces 132*a* and 132*b* does not have the bent portion 134 and is formed in a flat plate shape.

Further, the surrounding member 104 in the present example further includes an intermediate frame portion 140. The intermediate frame portion 140 is disposed between the first frame portion 110 and the second frame portion 120 and also between the first folded piece 132*a* and the second folded piece 132*b*.

When the surrounding member 104 in the unloaded state in the present example is compressed, the intermediate frame portion 140 rotates relative to the first frame portion 110 and the second frame portion 120 in the circumferential direction while reducing the angle formed by the first folded piece 132*a* and the second folded piece 132*b*.

In the example shown in each of FIGS. 21 and 22, the surrounding member 104 has a two-layer structure in which each folded piece 132*a* and each folded piece 132*b* are stacked in the thickness direction with the intermediate frame portion 140 interposed therebetween, but the surrounding member 104 may include a plurality of intermediate frame portions 140 and may have a multilayer structure in which three or more folded pieces are stacked in the thickness direction.

The compression rigidity or the tensile rigidity of the surrounding member 104 can be adjusted by adjusting the thickness of each of the coupling portions 130 coupling the plurality of frame portions of the surrounding member 104, the gap between the coupling portions 103 adjacent to each other, the direction in which each coupling portion 130 falls down when it is compressed, and the like.

Ninth Modification

Figure 24:
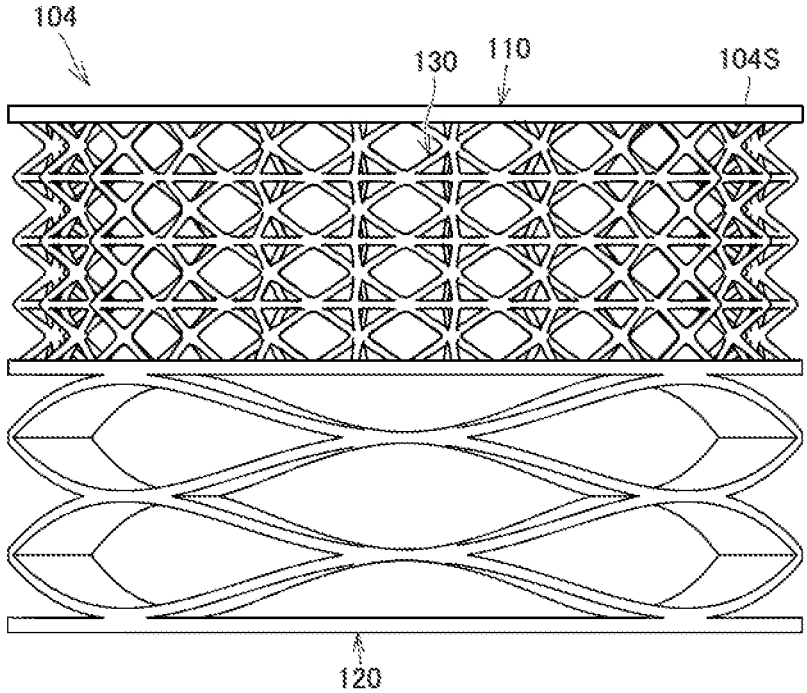
FIG. 24 is a front view of a modification of the surrounding member.

The surrounding member 104 may have a structure in which at least two surrounding members selected from the surrounding member 104 in the above-described embodiment and the surrounding members 104 in the sixth to eighth modifications are stacked in the thickness direction. For example, the surrounding member 104 shown in FIG. 23 has a structure in which the surrounding member 104 in the above-described embodiment is stacked on the surrounding member 104 in the sixth modification. The surrounding member 104 shown in FIG. 24 has a structure in which the surrounding member 104 in the seventh modification is stacked on the surrounding member 104 in the sixth modification.

As described above, by selecting the structure of the surrounding members stacked on top of one another, the compression rigidity can be adjusted (for example, the compression rigidity at the early stage in which the foot lands on the ground can be lowered). In addition, the shear rigidity can also be adjusted.

It will be appreciated by those skilled in the art that above-described exemplary embodiments are specific examples of the aspects as described below.

[Aspect 1]

A sole including:

a sole body;

an elastic portion formed of an elastic body and disposed adjacent to the sole body;

a surrounding member that surrounds the elastic portion, the surrounding member being made of a material higher in elastic modulus than a material forming the elastic portion; and a pressing member fixed to the surrounding member in a state in which the pressing member presses the elastic portion in a thickness direction of the sole body, wherein tensile rigidity of the surrounding member in the thickness direction is higher than compression rigidity of the elastic portion in the thickness direction and higher than compression rigidity of the surrounding member in the thickness direction, an uncompressed thickness denotes a thickness of the elastic portion in an uncompressed state in which a compressive load including pressing force applied by the pressing member does not act on the elastic portion, an initial thickness denotes a thickness of the surrounding member in an initial state in which a load in the thickness direction does not act on the surrounding member, and the uncompressed thickness is larger than the initial thickness, and a reference thickness denotes a thickness of the elastic portion and the surrounding member in a state in which the elastic portion receives the pressing force applied by the pressing member and the surrounding member receives a tensile load from the pressing member such that a top surface of the elastic portion is flush with a top surface of the surrounding member and in an unloaded state in which a load from a wearer does not act on the elastic portion and the surrounding member, and the reference thickness is smaller than the uncompressed thickness of the elastic portion and larger than the initial thickness of the surrounding member.

In the above-described sole, the impact applied when a foot lands on the ground is effectively absorbed by the sole body, and the elastic portion that is being compressed from the uncompressed state to the unloaded state is disposed, so that excessive compression (sinking) of the sole occurring when the foot pushes off the ground is suppressed.

Further, since the surrounding member having tensile rigidity higher than the compression rigidity of the elastic portion surrounds the elastic portion, the portion of the sole body that is adjacent to the elastic portion is suppressed from being pulled by the restoring force of the elastic portion (the force with which the elastic portion in the unloaded state returns to the uncompressed state).

In addition, the compression rigidity of the surrounding member is lower than the tensile rigidity of the surrounding member, which allows effective reduction of the reaction force that is received by a wearer from the surrounding member when the wearer's foot lands on or pushes off the ground.

[Aspect 2]

The sole according to aspect 1, wherein the surrounding member includes a first frame portion formed in a frame shape, a second frame portion formed in a frame shape and disposed below the first frame portion, and a plurality of coupling portions that couple the first frame portion to the second frame portion, at least two coupling portions of the plurality of coupling portions and the first frame portion are connected at a first connecting portion, and a plurality of the first connecting portions are arranged at intervals in a circumferential direction of the first frame portion, and at least two coupling portions of the plurality of coupling portions and the second frame portion are connected at a second connecting portion, and a plurality of the second connecting portions are arranged at intervals in a circumferential direction of the second frame portion.

[Aspect 3]

The sole according to aspect 3, wherein each of the plurality of coupling portions includes at least one folded portion formed between the first frame portion and the second frame portion, the at least one folded portion includes a first folded piece having a shape extending gradually downward toward one side in the circumferential direction, and a second folded piece having a shape extending gradually downward from a lower end portion of the first folded piece toward the other side in the circumferential direction, and an angle formed by the first folded piece and the second folded piece gradually becomes smaller as the surrounding member is compressed.

In the above-described aspect, the compression rigidity of the surrounding member can be lowered.

[Aspect 4]

The sole according to aspect 3, wherein the folded portions adjacent to each other in the circumferential direction are joined to each other.

In the above-described aspect, deformation of the surrounding member in the thickness direction is stabilized.

[Aspect 5]

The sole according to any one of aspects 2 to 4, wherein each of the plurality of coupling portions includes a bent portion.

In the above-described aspect, the compression rigidity of the surrounding member can be further lowered.

[Aspect 6]

The sole according to any one of aspects 2 to 5, wherein the plurality of coupling portions are configured to be compressed within a projection plane of the first frame portion.

In the above-described aspect, the elastic portion and the surrounding member are suppressed from coming into contact with each other during compressive deformation of the elastic portion and the surrounding member.

[Aspect 7]

The sole according to any one of aspects 2 to 6, wherein a gap is provided between the elastic portion in the unloaded state and the first frame portion and the plurality of coupling portions in the unloaded state.

In the above-described aspect, the elastic portion is suppressed from coming into contact with the first frame portion and each of the coupling portions during compressive deformation of the elastic portion and the surrounding member.

[Aspect 8]

The sole according to any one of aspects 2 to 7, wherein a top surface of the elastic portion in the uncompressed state protrudes upward from a top surface of the sole body, and the pressing member is fixed to a top surface of the sole body and the first frame portion in a state in which the pressing member presses the elastic portion in the unloaded state.

In the above-described aspect, the elastic portion is effectively maintained in the unloaded state, and the positional displacement of the elastic portion and the surrounding member relative to the sole body is effectively suppressed.

[Aspect 9]

The sole according to aspect 8, wherein the first frame portion has a shape protruding outward in an orthogonal direction from an outer edge portion of each of the plurality of coupling portions that extends in the orthogonal direction, the orthogonal direction being orthogonal to the thickness direction.

In the above-described aspect, since a large area of contact between the first frame portion and the pressing member is ensured, the above-described effect can be more reliably achieved.

[Aspect 10]

The sole according to any one of aspects 2 to 9, wherein the surrounding member further includes a bottom wall connected to the second frame portion to support the elastic portion.

In the above-described aspect, the elastic portion is more reliably maintained in the unloaded state.

[Aspect 11]

The sole according to any one of aspects 1 to 10, wherein the sole body further includes an accommodation portion that accommodates the elastic portion and the surrounding member.

[Aspect 12]

The sole according to any one of aspects 1 to 11, wherein the sole body includes a lower midsole, and an upper midsole disposed on the lower midsole, the pressing member is disposed between the upper midsole and the lower midsole, and the elastic portion and the surrounding member are disposed below the pressing member.

In the above-described aspect, the impact is reduced by the upper midsole when a foot lands on the ground, and excessive sinking is suppressed by the elastic portion when the foot pushes off the ground.

[Aspect 13]

A shoe including:

the sole according to any one of aspects 1 to 12; and an upper connected to the sole to form, together with the sole, a space that accommodates a foot of the wearer.

Although the embodiment of the present disclosure has been described as above, it should be understood that the embodiment disclosed herein is illustrative and non-restrictive in every respect. The scope of the present disclosure is defined by the scope of the claims and is intended to include any modifications within the meaning and scope equivalent to the terms of the claims.

What is claimed is:

1. A sole comprising:

a sole body;

an elastic portion formed of an elastic body and disposed adjacent to the sole body;

a surrounding member that surrounds the elastic portion, the surrounding member being made of a material higher in elastic modulus than a material forming the elastic portion, the surrounding member having an annular configuration; and a pressing member fixed to the surrounding member in a state in which the pressing member presses the elastic portion in a thickness direction of the sole body;

wherein a tensile rigidity of the surrounding member in the thickness direction is higher than a compression rigidity of the elastic portion in the thickness direction and higher than a compression rigidity of the surrounding member in the thickness direction;

wherein an uncompressed thickness denotes a thickness of the elastic portion in an uncompressed state in which a compressive load including pressing force applied by the pressing member does not act on the elastic portion, an initial thickness denotes a thickness of the surrounding member in an initial state in which a load in the thickness direction does not act on the surrounding member, and the uncompressed thickness is larger than the initial thickness; and wherein a reference thickness denotes a thickness of the elastic portion and the surrounding member in a state in which the elastic portion receives the pressing force applied by the pressing member and the surrounding member receives a tensile load from the pressing member such that a top surface of the elastic portion is flush with a top surface of the surrounding member and in an unloaded state in which a load from a wearer does not act on the elastic portion and the surrounding member, and the reference thickness is smaller than the uncompressed thickness of the elastic portion and larger than the initial thickness of the surrounding member.

2. The sole according to claim 1, wherein the sole body further includes an accommodation portion that accommodates the elastic portion and the surrounding member.

3. The sole according to claim 1, wherein the sole body includes:

a lower midsole; and an upper midsole disposed on the lower midsole;

wherein the pressing member is disposed between the upper midsole and the lower midsole; and wherein the elastic portion and the surrounding member are disposed below the pressing member.

4. A shoe comprising:

the sole according to claim 1; and an upper connected to the sole to form, together with the sole, a space that accommodates a foot of the wearer.

5. The sole according to claim 1, wherein the surrounding member includes:

a first frame portion formed in a frame shape;

a second frame portion formed in a frame shape and disposed below the first frame portion; and a plurality of coupling portions that couple the first frame portion to the second frame portion;

wherein at least two coupling portions of the plurality of coupling portions and the first frame portion are connected at a first connecting portion, and a plurality of the first connecting portions are arranged at intervals in a circumferential direction of the first frame portion; and wherein at least two coupling portions of the plurality of coupling portions and the second frame portion are connected at a second connecting portion, and a plurality of the second connecting portions are arranged at intervals in a circumferential direction of the second frame portion.

6. The sole according to claim 5, wherein each of the plurality of coupling portions includes a bent portion.

7. The sole according to claim 5, wherein the plurality of coupling portions are configured to be compressed within a projection plane of the first frame portion.

8. The sole according to claim 5, wherein a gap is provided between the elastic portion in the unloaded state and the first frame portion and the plurality of coupling portions in the unloaded state.

9. The sole according to claim 5, wherein:

a top surface of the elastic portion in the uncompressed state protrudes upward from a top surface of the sole body; and the pressing member is fixed to the top surface of the sole body and the first frame portion in a state in which the pressing member presses the elastic portion in the unloaded state.

10. A sole comprising:

a sole body;

an elastic portion formed of an elastic body and disposed adjacent to the sole body;

a surrounding member that surrounds the elastic portion, the surrounding member being made of a material higher in elastic modulus than a material forming the elastic portion; and a pressing member fixed to the surrounding member in a state in which the pressing member presses the elastic portion in a thickness direction of the sole body;

wherein a tensile rigidity of the surrounding member in the thickness direction is higher than a compression rigidity of the elastic portion in the thickness direction and higher than a compression rigidity of the surrounding member in the thickness direction, direction;

wherein an uncompressed thickness denotes a thickness of the elastic portion in an uncompressed state in which a compressive load including pressing force applied by the pressing member does not act on the elastic portion, an initial thickness denotes a thickness of the surrounding member in an initial state in which a load in the thickness direction does not act on the surrounding member, and the uncompressed thickness is larger than the initial thickness, thickness;

wherein a reference thickness denotes a thickness of the elastic portion and the surrounding member in a state in which the elastic portion receives the pressing force applied by the pressing member and the surrounding member receives a tensile load from the pressing member such that a top surface of the elastic portion is flush with a top surface of the surrounding member and in an unloaded state in which a load from a wearer does not act on the elastic portion and the surrounding member, and the reference thickness is smaller than the uncompressed thickness of the elastic portion and larger than the initial thickness of the surrounding member; and wherein the surrounding member includes:

a first frame portion formed in a frame shape;

a second frame portion formed in a frame shape and disposed below the first frame portion; and a plurality of coupling portions that couple the first frame portion to the second frame portion;

wherein at least two coupling portions of the plurality of coupling portions and the first frame portion are connected at a first connecting portion, and a plurality of the first connecting portions are arranged at intervals in a circumferential direction of the first frame portion; and wherein at least two coupling portions of the plurality of coupling portions and the second frame portion are connected at a second connecting portion, and a plurality of the second connecting portions are arranged at intervals in a circumferential direction of the second frame portion.

11. The sole according to claim 10, wherein:

each of the plurality of coupling portions includes at least one folded portion formed between the first frame portion and the second frame portion; and the at least one folded portion includes:

a first folded piece having a shape extending gradually downward toward one side in the circumferential direction; and a second folded piece having a shape extending gradually downward from a lower end portion of the first folded piece toward the other side in the circumferential direction;

wherein an angle formed by the first folded piece and the second folded piece gradually becomes smaller as the surrounding member is compressed.

12. The sole according to claim 11, wherein the folded portions adjacent to each other in the circumferential direction are joined to each other.

13. The sole according to claim 10, wherein each of the plurality of coupling portions includes a bent portion.

14. The sole according to claim 10, wherein the plurality of coupling portions are configured to be compressed within a projection plane of the first frame portion.

15. The sole according to claim 10, wherein a gap is provided between the elastic portion in the unloaded state and the first frame portion and the plurality of coupling portions in the unloaded state.

16. The sole according to claim 10, wherein:

a top surface of the elastic portion in the uncompressed state protrudes upward from a top surface of the sole body; and the pressing member is fixed to the top surface of the sole body and the first frame portion in a state in which the pressing member presses the elastic portion in the unloaded state.

17. The sole according to claim 16, wherein the first frame portion has a shape protruding outward in an orthogonal direction from an outer edge portion of each of the plurality of coupling portions that extends in the orthogonal direction, the orthogonal direction being orthogonal to the thickness direction.

18. The sole according to claim 10, wherein the surrounding member further includes a bottom wall connected to the second frame portion to support the elastic portion.

19. The sole according to claim 10, wherein the sole body includes:

a lower midsole; and an upper midsole disposed on the lower midsole;

wherein the pressing member is disposed between the upper midsole and the lower midsole; and wherein the elastic portion and the surrounding member are disposed below the pressing member.

20. A shoe comprising:

the sole according to claim 10; and an upper connected to the sole to form, together with the sole, a space that accommodates a foot of the wearer.

* * * * *